US009308574B1

(12) United States Patent
Mele

(10) Patent No.: US 9,308,574 B1
(45) Date of Patent: Apr. 12, 2016

(54) NET SHAPE FORGING PRESS AND SYSTEM

(71) Applicant: Joseph Mele, Oriental, NC (US)

(72) Inventor: Joseph Mele, Oriental, NC (US)

( * ) Notice: Subject to any disclaimer, the term of this patent is extended or adjusted under 35 U.S.C. 154(b) by 0 days.

(21) Appl. No.: 14/570,264

(22) Filed: Dec. 15, 2014

(51) Int. Cl.

| | |
|---|---|
| ***B21J 1/06*** | (2006.01) |
| ***B21J 5/02*** | (2006.01) |
| ***B21J 13/02*** | (2006.01) |
| ***B21J 13/08*** | (2006.01) |

(52) U.S. Cl.
CPC .. *B21J 5/022* (2013.01); *B21J 1/06* (2013.01); *B21J 13/02* (2013.01); *B21J 13/08* (2013.01)

(58) Field of Classification Search
CPC ..... B30B 1/40; B21D 5/02; B21J 1/06; B21J 9/08; B21J 7/02; B21J 7/16; B21J 9/12; B21J 13/02; B21J 13/04
USPC ..... 72/184, 264, 452.9, 452.8, 472
See application file for complete search history.

(56) References Cited

U.S. PATENT DOCUMENTS 3,626,746 A * 12/1971 Pietryka ..... B21J 7/18 72/189
3,847,004 A * 11/1974 Bringewald ..... B21J 13/02 72/184
4,608,848 A * 9/1986 Mele ..... B21J 13/02 72/184
4,770,020 A * 9/1988 Mele ..... B21J 13/02 72/184
8,779,620 B1 * 7/2014 Mele ..... F03D 3/061 290/55
2014/0090443 A1 * 4/2014 Schmauder ..... B21D 28/002 72/452.9

* cited by examiner

*Primary Examiner* — Alexander P Taousakis
*Assistant Examiner* — Pradeep C Battula
(74) *Attorney, Agent, or Firm* — Baker Hostetler LLP

(57) ABSTRACT

A system and forging press for flow forging a metal workpiece into a shaped part under pressure including a heating station, a die assembly, and a trailing assembly with the forging press including a support frame having an upper frame section, a lower frame section and side sections, an upper platen adapted to be suspended vertically, a lower platen spaced apart from the upper platen, a wedge assembly mounted in sliding engagement upon the upper platen relative to the upper frame section and having inclined surfaces adapted to engage the upper frame section, a first roller assembly surrounding the upper platen in a continuous loop; a second roller assembly surrounding the lower platen and a motorized worm gear assembly for controllably moving the wedge assembly as the die assembly, including the workpiece to be forged, is moved in a transport direction between the upper and lower platen.

12 Claims, 6 Drawing Sheets

NET SHAPE FORGING PRESS AND SYSTEM

FIELD OF THE INVENTION

The present invention relates to a forging press and system for forming a part by flow forging a metal workpiece under the application of continuous pressure.

BACKGROUND OF THE INVENTION

Conventional flow forging is currently practiced using a very large forging press, which can be as tall as 50 feet above ground level and rated at upwards of 50,000 tons, in conjunction with a matched male and female die system. One major disadvantage of a conventional forging press is the need, following forging, to further machine the forged part into a finished product. Conventional flow forging results in a substantial amount of flash removal and the requirement for machining following forging typically results in a substantial amount of scrap waste. A second major disadvantage of a conventional forging press is the necessity to construct a deep foundation extending as much as 70 feet underneath the forging press to enable the press to apply the desired pressure.

A part forming apparatus for forging a large part from a workpiece in a precise manner is taught and described in U.S. Pat. Nos. 4,608,848 and 4,770,020, which issued to the inventor of the subject application. The disclosures from both of the aforementioned patents are incorporated herein, in their entirety, by reference. The part forming apparatus taught in the foregoing patents constitutes a pressure transforming apparatus which creates a pressure zone for gradually forging the workpiece under pressure into a finished product. The workpiece is transported from from a die assembly and guided by a roller conveyor through the pressure zone of the part transforming apparatus in a given transport direction with the die assembly being pulled by a hydraulically operated drive mechanism. The roller conveyor is attached to a cable which is secured, in turn, through a pulley attached by brackets to a frame. The frame supports a pressure unit above a base member upon which the drive mechanism transporting the die assembly is mounted. A release station is used to release the die after passing through the pressure zone.

The subject invention constitutes a substantial improvement of the part forming apparatus taught in the aforementioned patents of the subject inventor in the construction of the forging press and in the system of the subject invention. The subject invention controls the build up of pressure generated between a male and female die as the die assembly is passed through the forging press to produce a finished part with no flashing.

The forging press and system of the present invention is less expensive to build, operate and maintain compared to conventional pressure forging presses in current use and compared to the part forming apparatus taught in the earlier aforementioned patents of the inventor of the subject invention. Moreover, the forging press and system of the present invention can be mounted at ground level without the necessity to construct a foundation below ground level to support the forging press. In addition, the forging press of the subject invention can forge metal parts free of voids, flaws and overlaps and without creating flash and/or waste. Accordingly, no machining of the forged part is necessary following the forging operation. Furthermore, the forging press and system of the present invention is able to fabricate a forged part of any desired length and is capable of forging longer parts than heretofore possible using conventional pressure forging systems.

BRIEF SUMMARY OF THE INVENTION

The forging press of the present invention is an integrated unit for flow forging a metal workpiece into a shaped part under the application of continuous pressure comprising: a support frame having a central opening forming an upper frame section, a lower frame section and side sections, an upper platen adapted to be suspended vertically from the upper frame section of the support frame, a lower platen extending from the lower frame section at a location spaced apart from the upper platen, a shoulder extending from each opposite side of the upper platen adjacent each side section of the support frame respectively, a wedge assembly including a first and second wedge member mounted in sliding engagement upon each shoulder of the upper platen at a position disposed between the upper platen and the upper frame section, with the first and second wedge members each having an inclined surface on one side thereof adapted to engage the upper frame section, an end support member interconnecting the first and second wedge members at a location external of the support frame; a first endless roller assembly surrounding the upper platen in a continuous loop; a second endless roller assembly surrounding the lower platen in a continuous loop with the first endless roller assembly facing the second endless roller assembly in substantial parallel alignment; and a motorized worm gear assembly for controllably moving said wedge assembly in or out of the central opening of the support frame to cause the first and second wedge members to slide upon the shoulders of the upper platen for moving the upper platen in a direction relative to the lower platen such that when a metal workpiece is transported in a die assembly between the first and second endless roller assembly during operation of the forging press the workpiece is compressed at a controlled pressure between the upper and lower platens.

The system of the present invention for flow forging a metal workpiece into a shaped part under the application of continuous pressure comprises in combination; a heating station for preheating the metal workpiece, a die assembly, including a male die composed of a plurality of male die segments and a female die, a forging press and a trailing assembly, with the trailing assembly including an hydraulically operated piston drive assembly for transporting the die assembly and heated workpiece from the heating station through the forging press, wherein the forging press comprises: a support frame having an upper frame section, a lower frame section and side sections, an upper platen adapted to be suspended from the upper frame section of the support frame with the upper platen having a tapered inclined surface at least on one end thereof, a lower platen extending from the lower frame section at a location spaced apart and in parallel alignment to the upper platen, a wedge assembly mounted upon the upper platen in sliding engagement between the upper platen and the upper frame section, an endless roller assembly surrounding the upper platen with the endless roller forming a continuous loop about the upper platen; and a motorized worm gear assembly for controllably moving said wedge assembly so that the upper platen moves in a direction relative to the lower platen for controlling the pressure applied to the workpiece as the workpiece is moved with the die assembly in a transport direction between the upper and lower platen such that each of said plurality male die segments is pressed gradually and sequentially against the workpiece into the female die as the die assembly moves through the press.

BRIEF DESCRIPTION OF THE DRAWINGS

FIG. 6(*a*) is an exploded elevational view of the individual components of die assembly shown in FIG. 6;

FIG. 6(*b*) is a perspective view of a finished forged part upon its removal from the female die of FIGS. 6 and 6(*a*)

DETAILED DESCRIPTION OF THE INVENTION

Figure 1:
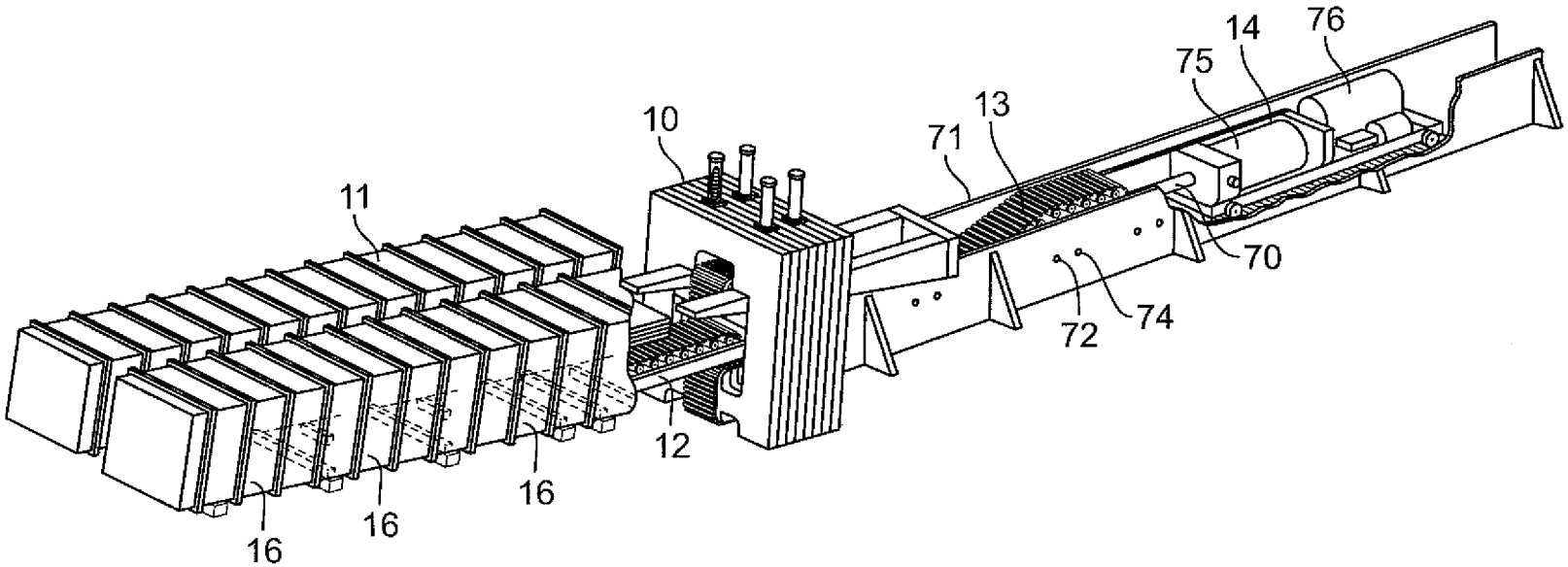
FIG. 1 is an overall plan view of the system and forging press of the present invention for forging a part in any desired length.
Figure 6:
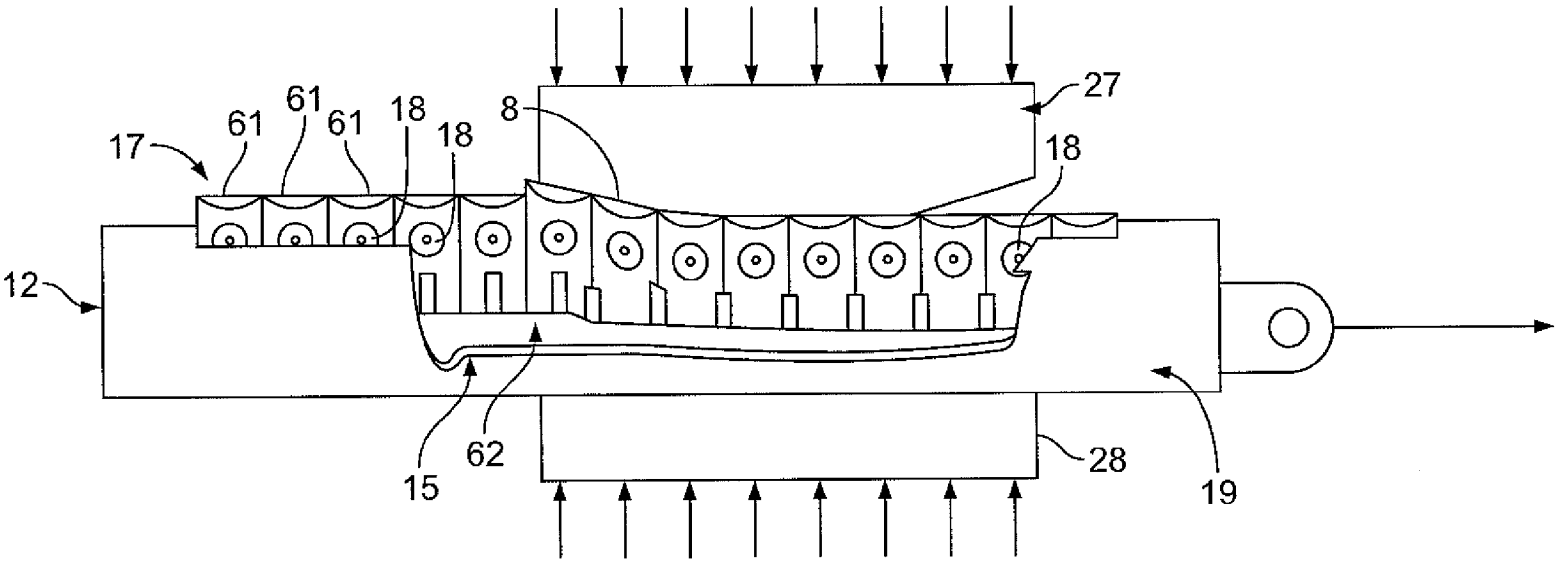
FIG. 6 is a diagrammatic view in side elevation of the die assembly of FIG. 1 shown pulled between the upper and lower platen of the forging press.
Figure 6A:
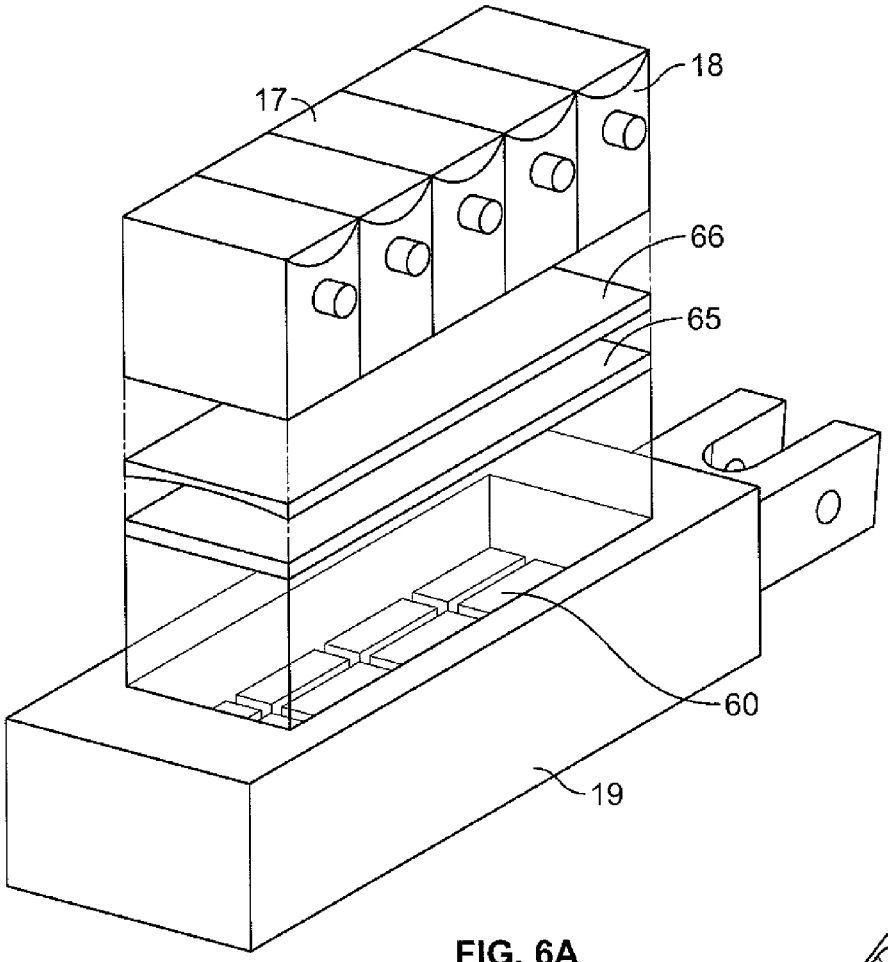

Referring to the drawings, the forging press 10 of the present invention is shown in FIG. 1, representing a system overall plan view of the present invention, illustrating the forging press 10 in combination with a heating furnace 11, a die assembly 12 and a trailing assembly 13. The trailing assembly 13 includes an hydraulically operated piston drive unit 14, and a conventional hydraulic tank 76 which is connected to a conventional hydraulic pressure cylinder 75 in the piston drive unit 14, for pulling or pushing the die assembly 12, which carries the part 15, i.e., the workpiece to be forged as shown in FIGS. 6 and 6(*b*), through the forging press 10. The heating furnace 11 in the system of FIG. 1 raises the temperature of the workpiece 15 to any desirable temperature in a conventional manner before the workpiece 15 is passed through the press 10. However, in accordance with the present invention, the heating furnace 11 is constructed as a modular assembly composed of a plurality of individual conventional heating units 16 such that the length of the workpiece 15 to be forged in the press 10 may be varied by selecting a number of heating units 16 based upon the length of the workpiece to be forged. The die assembly 12 comprises a male die 17, composed of a plurality of male segments 18, with the number of male die segments 18 selected to be equal in length to the length of the forged workpiece 15, and a female die 19. This will be explained in greater detail in connection with FIGS. 7(*a*)-7(*c*) respectively which diagrammatically illustrates how forged parts of different lengths are formed in the system of the present invention shown in FIG. 1.

Figure 2:
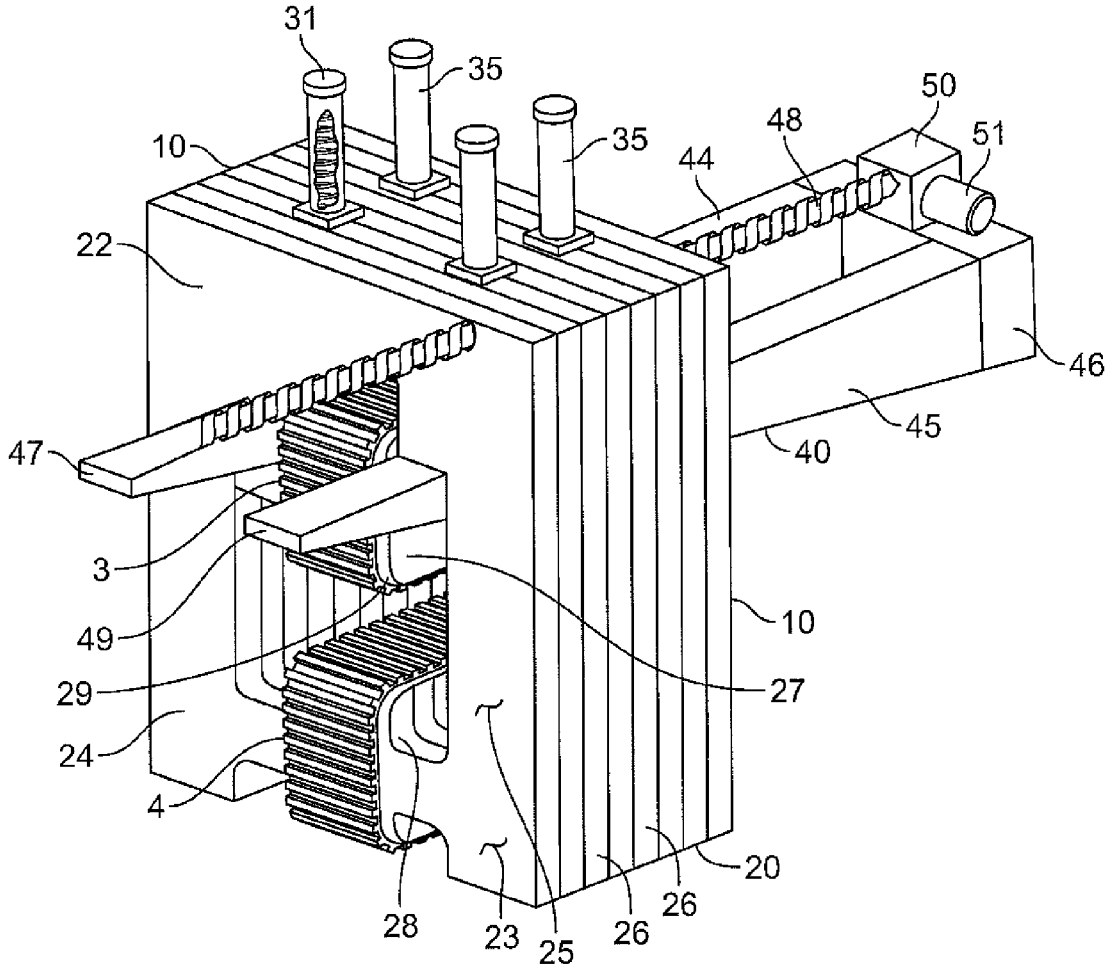
FIG. 2 is a perspective view of the forging press of the present invention shown in FIG. 1.
Figure 3:
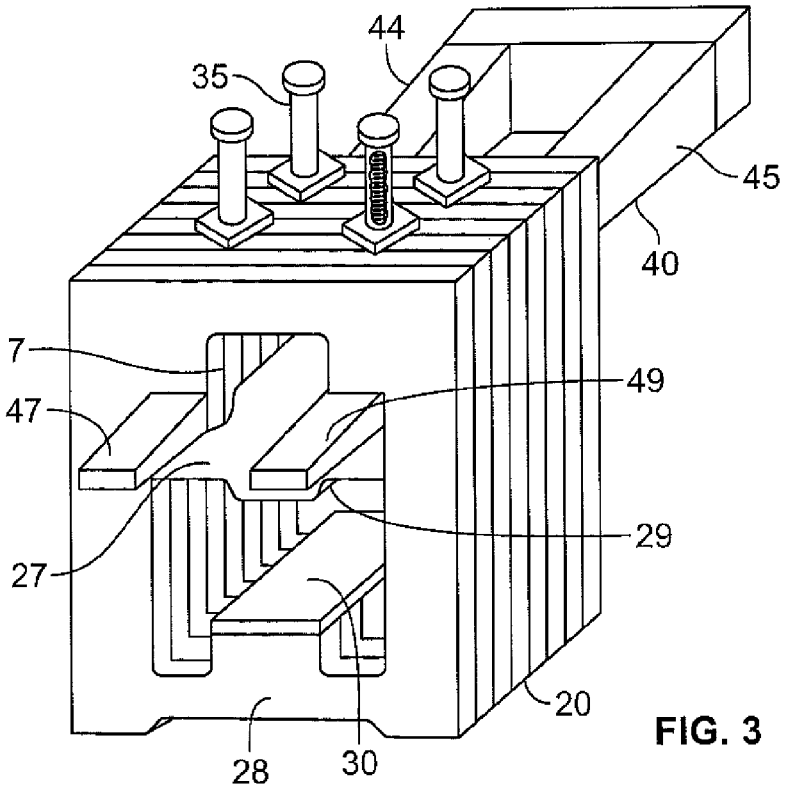
FIG. 3 is another perspective view of the forging press of the present invention shown in FIG. 2 illustrating primarily the upper and lower platen without showing the roller assemblies and motorized worm gear assembly shown in FIG. 2.
Figure 4:
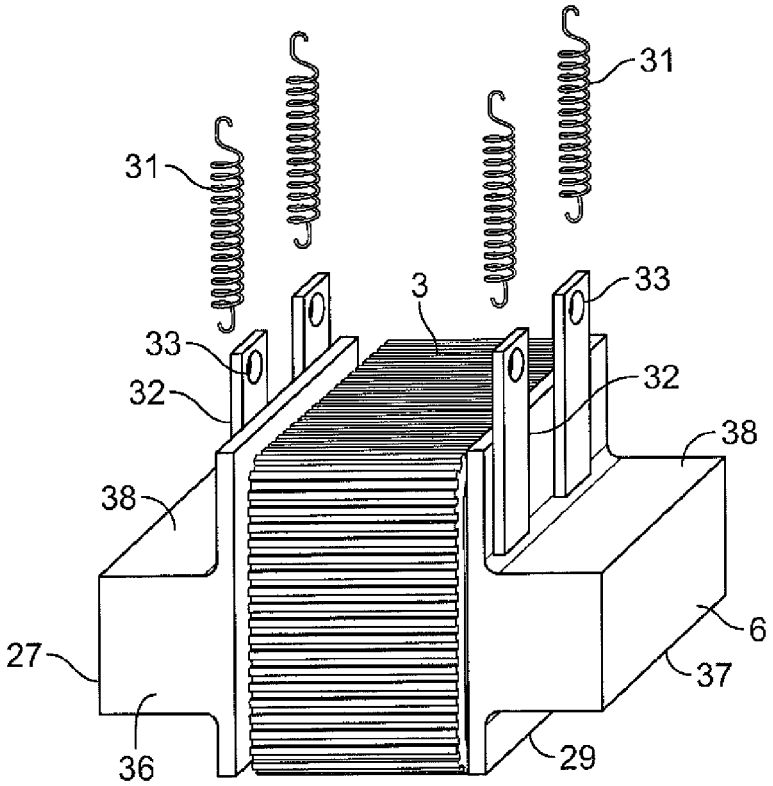
FIG. 4 is an exploded perspective view of the upper platen and roller assembly in the forging press shown in FIG. 2 shown in conjunction with a plurality of spring members for suspending the upper platen within a central opening in the support frame of the forging press of FIG. 2.

The forging press 10 of the present invention is shown in perspective and in greater detail in FIGS. 2-4 with the forging press 10 comprising a structural support frame 20 having a central opening 21 dividing the support frame 20 into an upper frame section 22, a lower frame section 23 and vertical side sections 24 and 25 respectively. The structural support frame 20 of the forging press 10 comprises a plurality of relatively thin metal support plates 26, composed of e.g. steel, welded together to form a single integrated unit having a thickness based on the selected number of support plates 26. Alternatively, the support frame 20 may be represented by a single solid thick metal structure. The support frame 20 of the forging press 10 further comprises an upper platen 27 adapted to be suspended from the upper frame section 22 and a lower platen 28 with the upper platen 27 held suspended in a vertical orientation relative to the upper frame section 22 and to the lower platen 28. The lower platen 28 is formed directly from the lower frame section 23 of the support frame 20 or is a separate part affixed to the lower frame section 23 and is stationary. A flat plate 30 of hardened steel, as shown in FIG. 4, is preferably mounted upon the upper surface of the lower platen 28 in a fixed relationship to the bottom surface 29 the of upper platen 27 so that the plate 30 is in alignment with the bottom surface 29 of the upper platen 27.

The forging press 10 along with the heating furnace 11 and trailing assembly 13 of the present invention may be mounted on ground level or upon a reinforced concrete slab (not shown) mounted on ground level with the concrete slab providing additional support for the press 10 without the necessity to form a foundation under the forging press 10 below ground level.

The upper platen 27 is held suspended from the upper frame section 22 preferably in a vertical orientation using a plurality of spring members 31, as shown in FIG. 4, which are preferably secured to brackets 32 affixed to the upper platen 27 with one end of each spring member 31 hung from a hole 33 in each of the brackets 32 and with the opposite end of each spring member 31 secured to a housing 35 mounted upon the upper frame section 22 of the support frame 20. A plurality of holes (not shown) are formed in the upper frame section 22 of the support frame 20 to permit each of the spring members 31 to pass through the upper frame section 22 before attachment to the spring housings 35 which are preferably mounted upon the upper frame section 22 and spaced a predetermined distance apart in a fixed arrangement for supporting the upper platen 27 in suspension spaced apart from the upper frame section 22 and at a position juxtaposed in parallel alignment to the flat plate 30 on the lower platen 28.

The upper platen 27, as is shown in FIG. 4, is a body of substantially rectangular geometry having two shoulder sections 36 and 37 extending from opposite sides of the upper platen 27. The surfaces 38 and 38' of the two shoulder sections 36 and 37 are preferably flat. When the upper platen 20 is vertically suspended from the upper frame section 22 the shoulder sections 36 and 37 are oriented to extend horizontally toward each of the side sections 24 and 25 of the frame 20. The upper platen 27, as shown in the enlarged view of FIG. 5, has two tapered inclined surfaces 8 and 9 at each opposite end thereof.

As shown in FIG. 2(*a*) wedge assembly 40 is slidably mounted on the flat surfaces 38 and 38' of the shoulder sections 36 and 37 of the upper platen 27. A first endless roller chain assembly 3, as is shown in FIGS. 2 and 4, surrounds the upper platen 27 to form a continuous loop. A second endless roller chain assembly 4, as is shown in FIG. 2, surrounds the lower platen 28 to form a continuous loop with the second roller chain assembly 4 mounted on the flat plate 30 of the lower platen 28 so that the bottom end 29 of the upper platen 27 is in parallel alignment with the flat plate 30. The first endless roller chain assembly 3 is driven around the upper platen 27 in response to linear movement of the wedge assembly 40 in or out of the central opening 21 in the support frame of the press.

The wedge assembly 40 comprises a first wedge member 44 and a second wedge member 45 with the wedge members 44 and 45 interconnected to one another by an end support member 46 to form a horseshoe configuration. Each of the first and second wedge members 44 and 45 have an inclined surface 47 and 49 on one side thereof opposite the two shoulder sections 36 and 37 upon which the wedge members 44 and 45 are mounted. The inclined surfaces 47 and 49 of the wedge members 44 and 45 are disposed in sliding engagement against opposing surfaces (not shown) of the upper section 22 of the support frame 20 such that as the wedge assembly 40 is linearly moved in or out of the central opening 21 of the support frame 20 the upper platen 27 moves downwardly or upwardly relative to the position of the stationary lower platen 28. The end support member 46 interconnects the first and second wedge members 44 and 45 at a location external of the support frame 12. An elongated lead screw 48 extends through the upper section 22 of the support frame 20. The lead screw 48 is connected to a worm gear assembly 50, driven by a motor 51, preferably a stepping motor, with both the worm gear assembly 50 and the stepping motor 51 mounted on the end support member 46 of the wedge assembly 40. The worm gear assembly 50 is conventional and turns the lead screw 48 in a clockwise or counterclockwise direction upon manual or automatic operation of the stepping motor 51. The stepping motor 51 is operated either independent or in syncronism with the operation of the hydraulically operated piston drive unit 14 for controlling the pressure applied to the workpiece 15 as the workpiece 15 is advanced through the forging press 10.

The lead screw 48 is rotated by operation of the stepping motor 51 to cause the wedge assembly 40 to move laterally in a stepwise fashion through the central opening 21 of the support frame. When the lead screw 48 is rotated clockwise. the upper platen 27 moves downwardly toward the lower platen 28. The workpiece 15 is transported in the die assembly 12 through the forging press 10 between the upper platen 27 and the lower platen 28. When the die assembly 12 is pulled through the forging press 10 to the male die 17 engages the first endless roller chain assembly 3 causing the first endless roller chain assembly 3 to rotate about the upper platen relative to the second endless roller chain assembly 4 which compresses the workpiece 15 as the workpiece 15 passes between the upper platen 27 and the lower platen 28. The pressure applied to the workpiece 15 while the workpiece 15 is pulled through the forging press is controlled by the movement of the wedge assembly 40.

Figure 6B:
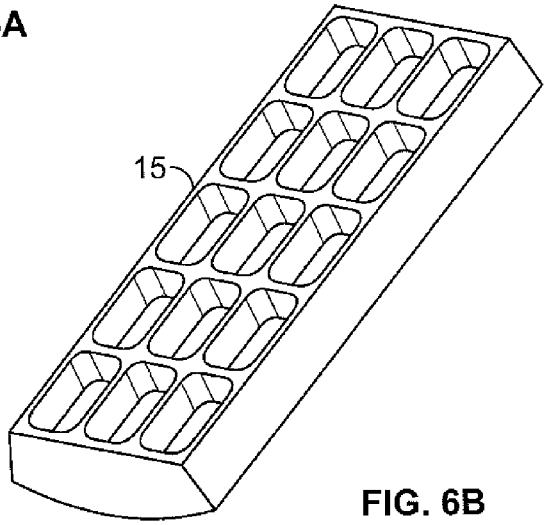

A diagrammatic view in side elevation of the die assembly 12 as it is being pulled by the hydraulically operated piston drive unit 14 between the upper and lower platen of the forging press 10 is shown in FIG. 6. The number of male segments 18 in the male die 17 is selected to conform to the length of the male die 17 and to the length of the workpiece 15 to be forged. The male segments 18 are arranged in an assembly as taught in U.S. Pat. No. 4,608,848 with each male segment 18 in the form of a cylindrical projection which constitutes a pressure transferring element comprising, in general, a concave pressure transferring upper surface 61 and a molding lower surface 62 as is shown in FIG. 6. The female die 19 as shown in FIG. 6(*a*) is preferably a single piece having a die cavity 60 of a geometry and size which conforms to the desired geometry and size of the forged workpiece 15. The forged workpiece 15 may initially represent plate stock 65 as shown in FIG. 6(*a*) with FIG. 6*b* showing an example of the workpiece 15 after it is forged into a shaped part. The length of the die cavity 60 in the female die 19 needs to accommodate the length of the male die segments 18.

Figure 5:
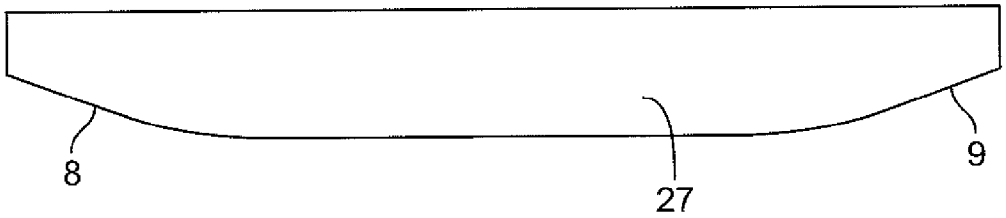
FIG. 5 is an enlarged side elevation of only the upper platen shown in FIG. 4 taken along the lines 5-5 with the roller assembly and brackets for supporting the spring members omitted.

The first endless roller chain assembly 3 engages the upper surface 61 of each of the male segments 18 as it rotates around the upper platen 27 in response to the advancement of the die assembly 12 through the forging press 10 causing each male segment 18 to be pressed sequentially into the female die cavity 60 of the female die 19. The lower surfaces 62 of each of the male segments 18 constitutes a molding surface which actually comes into direct contact with the plate stock 65 for forging the workpiece 15 or contacts the plate stock 65 through a cover plate 66 placed between the plate stock 65 and the lower surfaces 62 of the male segments 18. The die assembly 12 is either being pulled in a transport direction from left to right through the forging press 10 as is shown in FIG. 6 or is being pushed in a transport direction from right to left through the forging press 10 representing the opposite direction. Since the roller chain assembly 3 follows the surface curvature of the upper platen 27 when the die assembly 12 is pulled in a transport direction from left to right the male segments 18 are each gradually and sequentially moved downwardly as a result of the inclined tapered surface 8 at the front end of the forging press 10 as shown in FIGS. 5, 6 and 7(*a*)-7(*c*) respectively. The tapered surface 8 of the upper platen 27 causes each male segment 18 to be gradually and sequentially pressed into the die cavity 60 of the female die 19 as the die assembly 12 is pulled in a transport direction through the forging press 10.

The die assembly 12 may also be pushed in a transport direction through the forging press 10 in the direction opposite the pulling direction shown in FIG. 6 particularly in cases when reciprocation of the workpiece 15 through the forging press 10 in both directions is desired. This may be necessary if complete material flow is not achieved in one pass through the forging press 10. The gradual and sequential motion of the multiple male segments 18 of the male die 17 under the influence of the tapered upper surface 8 or 9, depending on the transport direction, creates a smooth and uniform flow of metal during compression of the plate stock 65 into the female die 19 thereby forming a forged workpiece 15 within the cavity 60 of the female die 19 which will be free of voids, flaws and overlaps. Control of the formation of a forged workpiece 15 free of voids, flaws and overlaps is best achieved when the die assembly 12 is moved through the forging press 10 at a relatively slow speed.

Figure 7A:
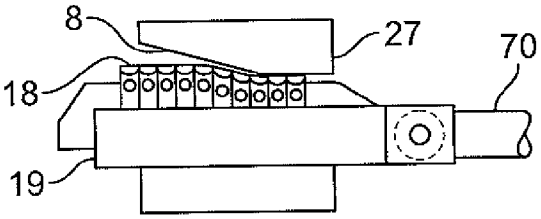
FIG. 7(*a*)-7(*c*) diagrammatically illustrates how forged parts having three different lengths are formed in the forging system of FIG. 1.
Figure 7B:
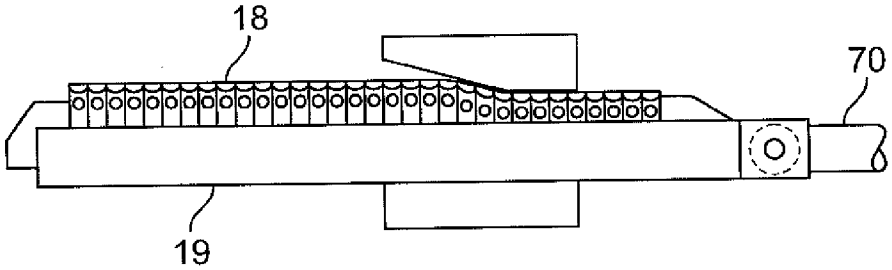
Figure 7C:
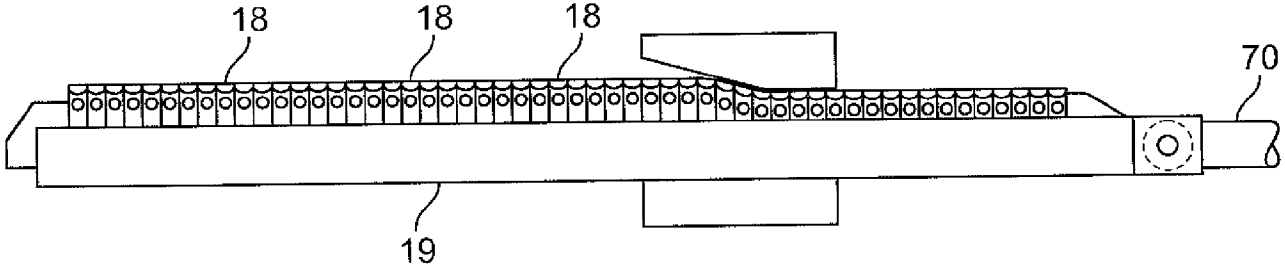

FIGS. 7*a*-7*c* illustrate how forged parts having three different lengths are formed using the system of the present invention as shown in FIG. 1. In FIG. 7(*a*) the length of the selected number of male die segments 18 is equal substantially to one foot in length for forming a workpiece 15 of one foot in length. The taper 8 of the upper platen 27 at the inlet end of the forging press 10 is shown exaggerated in FIG. 7(*a*) to emphasize a gradual sequential depression of the male segments 18 into the female die 19. In FIG. 7(*b*) the selected number of male die segments 18 has an aggregated length "x" representing approximately three times the length of the male die segments 18 in FIG. 7(*a*) for forging a workpiece 15 three times longer than the workpiece of FIG. 7(*a*). Likewise a workpiece may be forged having an extended length "y" as shown in FIG. 7(*c*) by selecting an appropriate number of male die segments 18 having a corresponding aggregated length "y". In each case, the length of the female die 19 needs to be equal in length to the length of the selected number of male segments 18. Likewise, the number of heating units 16 must also be varied to accommodate the number of male die segments 18 having a length "y".

The hydraulically operated piston drive unit 14 in the trailing assembly 13 shown in FIG. 1 may be conventional and substantially similar to its counterpart in U.S. Pat. No. 4,608,848. The female die 19 is affixed to a piston rod 70 which in turn is connected to an hydraulic cylinder 75 in the hydraulically operated piston drive unit 14. The piston rod 70 is retracted or extended for either pulling or pushing the female die 19, in a conventional manner, by the hydraulically operated piston drive unit 14. To accommodate longer workpieces using one hydraulic cylinder in the hydraulically operated piston drive unit 14 the die assembly 12 is withdrawn from the press 10 between two arbitrarily long indexing plates 71 and 72 extending from the press 10. The indexing plates 71 and 72 are parallel to one another and have a length to accommodate the different lengths of the workpiece 15 shown in FIG. 7(*a*)-7(*c*). The indexing plates 71 and 72 define a channel for withdrawing the die assembly 12 after the workpiece 15 is forged within the forging press 10 and may contain index holes 74 spaced a given distance apart from one another to permit the hydraulic cylinder 75 in the hydraulically operated piston drive unit 14 to be used to withdraw any length of workpiece. In such case, it is desirable to use a piston cylinder mechanism in which the piston is retractable within the cylinder as taught by the inventor in the aforementioned U.S. Pat. No. 4,608,848 so that the cylinder 75 and piston rod 70 can be operated using the index holes 74 to advance the piston and cylinder within the indexing plates to withdraw any length of workpiece which the length of the indexing plates will accommodate. For example if the cylinder 75 has a stroke of six feet, the cylinder 75 may be used to pull the piston rod 70 and die assembly 12 six feet out from the press 10. The piston rod 70 may then be locked into one set of index holes 74 and the cylinder 75 moved backwardly relative to the piston 70. The piston 70 may then be unlocked from set of index holes 74 and the cylinder and piston used to pull the die another six feet from the press etc. until the piston rod 70 approaches the end of the indexing plates 71 and 72. This procedure is explained in the aforementioned patent of the inventor U.S. Pat. No. 4,608,848.

Upon withdrawal of the die assembly 12 from the forging press 10 the male die segments 18 may be individually released to lift the male segments 18 out from the female die 19 as taught in U.S. Pat. No. 4,608,848 the disclosure of which has been incorporated by reference before removal of the forged workpiece 15. After the forged workpiece 15 is removed from the female die 19 the male die segments 18 are lowered back into the female die and the die assembly 12 moved back through the forging press 10 to enable the die assembly 12 to be reloaded with new plate stock 65 before or in the heating assembly 11 to begin the forging procedure anew.

The invention claimed is:

1. A forging press for flow forging a metal workpiece into a shaped part under the application of continuous pressure comprising: a support frame having a central opening forming an upper frame section, a lower frame section and side sections, an upper platen adapted to be suspended vertically from the upper frame section of the support frame, a lower platen extending from the lower frame section at a location spaced apart from the upper platen, with the upper platen comprising a shoulder extending from each opposite side thereof aligned substantially in a horizontal direction in relative close proximity to each side section of the support frame respectively, a wedge assembly including a first and second wedge member mounted in sliding engagement upon each shoulder of the upper platen at a position disposed between the upper platen and the upper frame section, with the first and second wedge members each having an inclined surface on at least one side thereof adapted to engage the upper frame section, an end support member interconnecting the first and second wedge members at a location external of the support frame; a first endless roller chain assembly surrounding the upper platen in a continuous loop; a second endless roller chain assembly surrounding the lower platen in a continuous loop with the first endless roller chain assembly facing the second endless roller chain assembly in substantial parallel alignment; and a motorized worm gear assembly for controllably moving said wedge assembly in or out of the central opening of the support frame so that the upper platen moves in a direction relative to the lower platen to control the pressure applied to the workpiece as the workpiece is transported via a die assembly between the upper and lower platens.

2. A forging press as defined in claim 1 wherein said support frame is composed of a plurality of metal plates integrated as a single unit to form a unitary structure of any desired thickness.

3. A forging press as defined in claim 2 wherein said lower platen is formed from or affixed to said lower frame section and includes a flat plate disposed on a surface thereof spaced apart from the upper platen upon which is mounted the second endless roller chain assembly.

4. A forging press as defined in claim 3 wherein said motorized worm gear assembly comprises a lead screw, a gear assembly and a motor with the lead screw extending from the gear assembly through the upper frame section of the support frame.

5. A forging press as defined in claim 4 wherein said gear assembly and motor is mounted on said end support member external of the support frame.

6. A forging press as defined in claim 4 wherein said motor is a stepping motor.

7. A system for flow forging a metal workpiece into a shaped part under the application of continuous pressure comprising in combination; a heating station for preheating the metal workpiece, a die assembly, including a male die composed of a plurality of male die segments and a female die, a forging press and a trailing assembly, with the trailing assembly including an hydraulically operated piston drive assembly for transporting the die assembly and heated workpiece from the heating station through the forging press, wherein the forging press comprises: a support frame having an upper frame section, a lower frame section and side sections, an upper platen adapted to be suspended from the upper frame section of the support frame with the upper platen comprising a shoulder extending from each opposite side thereof aligned substantially in a horizontal direction in relative close proximity to each side section of the support frame and a tapered inclined surface on each end thereof, a lower platen extending from the lower frame section at a location spaced apart and in parallel alignment to the upper platen, a wedge assembly mounted upon the upper platen in sliding engagement between the upper platen and the upper frame section, an endless roller chain assembly surrounding the upper platen, another endless roller chain assembly surrounding the lower platen with each endless roller chain assembly forming a continuous loop about the upper and lower platen respectively; and a motorized worm gear assembly for controllably moving said wedge assembly so that the upper platen moves in a direction relative to the lower platen for controlling the pressure applied to the workpiece as the workpiece is moved with the die assembly in a transport direction between the upper and lower platen such that each of said plurality male die segments is pressed gradually and sequentially against the workpiece into the female die as the die assembly moves through the press.

8. A system for flow forging as defined in claim 7 wherein each endless roller chain assembly is spaced apart from one another to enable the workpiece to be moved in a transport direction between both endless roller chain assemblies.

9. A system for flow forging as defined in claim 8 wherein said motorized worm gear assembly in said forging press comprises a lead screw, a gear assembly and a motor with the lead screw extending from the gear assembly through the upper frame section of the support frame for controlling the pressure applied to the workpiece as the workpiece moves between both endless roller chain assemblies.

10. A system for flow forging as defined in claim 9 wherein the length of the workpiece controls the number of male die segments in the die assembly such that any length of workpiece can be forged.

11. A system for flow forging as defined in claim 10 wherein the heating station for preheating the metal workpiece comprises a furnace of modular construction consisting of a plurality of heating units having a length to accommodate any length of workpiece based upon the number of male die segments.

12. A system for flow forging as defined in claim 11 wherein the trailing assembly further comprises two indexing plates defining a channel through which the die assembly following the forging operation is withdrawn with the indexing plates having index holes spaced a given distance apart along the longitudinal length of the plates for defining the distance the die assembly is to be withdrawn from the press so as to enable the hydraulically operated piston drive assembly to withdraw a workpiece of any desired length.

* * * * *